US008365961B2

(12) United States Patent
Donnette et al.

(10) Patent No.: US 8,365,961 B2
(45) Date of Patent: Feb. 5, 2013

(54) DEVICE FOR DELIVERING A SUBSTANCE, THE DEVICE INCLUDING A PUMP COMPRISING A STATIONARY PORTION AND A MOVABLE PORTION

(75) Inventors: Xavier Donnette, Soleymieu (FR); Julien Brand, Saint Clair de la Tour (FR); Gaetan Painchaud, Francheville (FR); Sylvain Lanzi, Chirens (FR); Francois Nicolle, Tourville la Chapelle (FR)

(73) Assignee: Rexam Healthcare la Verpilliere (FR)

( * ) Notice: Subject to any disclaimer, the term of this patent is extended or adjusted under 35 U.S.C. 154(b) by 384 days.

(21) Appl. No.: 12/701,266

(22) Filed: Feb. 5, 2010

(65) Prior Publication Data

US 2010/0224653 A1 Sep. 9, 2010

(30) Foreign Application Priority Data

Feb. 6, 2009 (FR) ..... 09 50775

(51) Int. Cl.
*B67B 1/00* (2006.01)

(52) U.S. Cl. ..... 222/153.01; 222/153.11; 222/321.9; 215/273; 215/274; 220/315; 220/319

(58) Field of Classification Search .... 222/321.7–321.9, 222/385, 340–341, 153.01, 153.11; 239/333; 220/315, 319; 215/273–274, 277, 280
See application file for complete search history.

(56) References Cited

U.S. PATENT DOCUMENTS 3,779,464 A * 12/1973 Malone ..... 239/350
4,050,613 A * 9/1977 Corsette ..... 222/321.2
4,083,476 A 4/1978 Schwartz et al.
4,343,417 A * 8/1982 Corsette ..... 222/153.13
4,496,082 A * 1/1985 Corsette ..... 222/153.13
5,307,953 A 5/1994 Regan
5,944,222 A * 8/1999 Fuchs et al. ..... 222/82
6,189,739 B1 2/2001 von Schuckmann
6,851,583 B2 * 2/2005 Masuzzo et al. ..... 222/321.6
2008/0115845 A1 5/2008 Leuliet et al.

FOREIGN PATENT DOCUMENTS

FR 2885887 A1 11/2006

OTHER PUBLICATIONS

Republic of France Preliminary Search Report and Written Opinion; FR 0950775; Sep. 15, 2009; 7 pages.

* cited by examiner

*Primary Examiner* — Frederick C. Nicolas
(74) *Attorney, Agent, or Firm* — St. Onge Steward Johnston & Reens LLC

(57) ABSTRACT

A device for delivering a substance, the device including a first stationary portion and a second movable portion that is movable relative to the first portion between a rest position and an activated position, the device further including an abutment for putting the movable portion into abutment relative to the stationary portion, which abutment needs to be forced past in order to enable the movable portion to go from its rest position to its activated position, the abutment carried by the movable portion and an abutment carried by the stationary portion, at least one of these abutments being mounted on a resilient portion of the stationary portion and/or of the movable portion, the resilient portion being deformable between an abutment configuration and a retraction configuration and having a reinforcement for reinforcing the resilient portion, namely a part that bears against a zone of the resilient portion.

15 Claims, 3 Drawing Sheets

DEVICE FOR DELIVERING A SUBSTANCE, THE DEVICE INCLUDING A PUMP COMPRISING A STATIONARY PORTION AND A MOVABLE PORTION

CROSS-REFERENCE TO RELATED APPLICATIONS

The present application claims priority of French patent application No. 0950775 filed on Feb. 6, 2009, the content of which is incorporated herein by reference.

FIELD OF THE INVENTION

The present invention relates to the technical field of dispensing a liquid, semiliquid, viscous, or gaseous substance, in particular in the medical field. A device used for dispensing the substance may comprise a pump, e.g. for nose sprays, or other types of dispenser means, e.g. a valve for dispensing an ophthalmic liquid, a device for inhaling a powder, or indeed a device for protecting syringes.

BACKGROUND OF THE INVENTION

In an example of a device that comprises a pump, as described in document FR 2 885 887, the device comprises a pump body and a dispenser head that is movably mounted on the pump body to move between a rest position and an activated position in order to deliver a predetermined dose of the substance. When the user desires to use the device, the user presses on the dispenser head so that it takes up its activated position and thus delivers a dose of substance.

It is found that the amount of substance delivered by the device can depend on the force exerted by the user on the movable portion of the device, here made up of the dispenser head. Depending on the force exerted by the user, it is possible to deliver a dose that is incomplete. The fact that the delivered dose is not constant is problematic since it may have non-negligible consequences when the substance is a medicament. Furthermore, in addition to the question of the quantity of substance that is delivered, the force exerted by the user may also affect the quality of a spray, in particular the size of the particles or droplets, and the angle and the density of the spray, which means that it is possible to generate sprays of poor quality. For example, when the dose is delivered with a stop along the stroke, the spray may take the form of a jet, whereas atomization in a mist is expected.

SUMMARY OF THE INVENTION

The present invention seeks in particular to provide a device that ensures that the doses of substance that are delivered are regular, from the quantity and/or quality points of view.

To this end, the invention provides a device for delivering a substance, the device comprising a first portion, referred to as a stationary portion, and a second portion that is movable relative to the first portion between a rest position and an activated position, said second portion being referred to as a movable portion, the device further comprising abutment means for putting the movable portion into abutment relative to the stationary portion, which means need to be forced past in order to enable the movable portion to go from its rest position to its activated position.

These abutment means thus constitute a hard point during activation, which hard point is preferably situated at the very beginning of the stroke of the movable portion. By providing such means, it is guaranteed that the user exerts at least some minimum force on the delivery device, i.e. a force that is sufficient to deliver a predefined dose of substance completely and/or to deliver a spray complying with expected characteristics, e.g. with a certain size for the droplets. Thus, a user exerting an insufficient force on the movable portion, instead of delivering an incomplete dose (as happens in a conventional device), is prevented from delivering any substance. This incites the user to press harder on the movable portion, and by exerting a stronger force that is sufficient to force past the abutment means, the user manages to deliver a dose that is complete. As a result the dose delivered by the device is regular, or reproducible, and thus independent of the user.

It will be understood that the movable portion and/or the stationary portion may themselves be made up of one or more distinct parts. In general, the movable portion co-operates with the stationary portion to define a metering chamber that defines a metering volume, corresponding to the difference between the volume of the chamber in a high position and the volume of the chamber in a low position. This metering volume determines the amount of substance that is delivered on each activation of the device. It should be observed that the metering volume does not necessarily correspond to the volume of the metering chamber, since the volume of the chamber in the low position is not necessarily zero.

It should also be understood that the abutment means may be arranged on any device that is intended to deliver a predetermined dose of substance and in which delivery requires triggering by a user applying a certain amount of force. In particular, the device may be a device with a pump, a device for delivering an ophthalmic fluid, a powder inhaler device, or indeed a device for protecting a syringe.

The above-described device may also include one or more of the following characteristics:

The abutment means are permanent, being designed to be forced past on each activation of the device by a user.

The abutment means are substantially punctual, i.e. their action is short relative to the stroke of the movable portion. Thus, after forcing past the abutment means the device is released, causing the movable portion to move fast, thereby enabling satisfactory activation of the device.

The abutment means are configured in such a manner that the force needed to force past them is greater than the force needed for the movable portion to reach the end of its stroke. In other words, the force for forcing past the abutment means obliges the movable portion to carry on to the end of its stroke in a single movement, thereby ensuring that the dose is delivered in a manner that is satisfactory in terms of quantity, quality, and reproducibility.

The abutment means comprise an abutment carried by the movable portion and an abutment carried by the stationary portion, at least one of the abutments being mounted on a resilient portion of the stationary portion and/or of the movable portion, which resilient portion is deformable between an abutment configuration and a retraction configuration, the resilient portion preferably being a resilient tab.

The device includes means for reinforcing the resilient portion, e.g. a part that bears against a zone of the resilient portion. These reinforcing means or stiffening means serve to increase the resistance of the resilient portion, and thus to increase the amount of force that needs to be applied to make it take up its retracted position. Thus, although a single resilient tab might retract after a relatively small amount of force, the reinforcing means can enable the resilient portion to be held so that it remains in the abutment configuration so long as the force is not sufficient to deliver the complete dose of substance.

The resilient portion comprises a tab having two opposite ends, the two ends being fastened on the stationary portion or being fastened on the movable portion. Thus, the resilient tab may have one of its ends mounted free relative to the stationary or movable portion, or it may have both ends secured to the stationary or movable portion of the device. Under such circumstances, it is the middle portion of the tab disposed between its two stationary ends that deforms in order to take up the retraction configuration. As a result, the resilient tab presents great resistance prior to taking up its retraction position and requires a relatively large amount of force to be applied by the user in order to activate the device.

The abutment means comprise an abutment that is slidably mounted relative to the stationary portion or to the movable portion, being movable between a retracted position and an abutment position under drive from return means bearing against said abutment, e.g. under drive from a spring or a resilient arm. Thus, the abutment means are forced past not as a result of elastic deformation of the movable portion or of the stationary portion, but as a result of deformation of return means enabling the abutment to slide, e.g. as a result of compressing a spring. It is thus possible to give greater resistance to the abutment means so as to guarantee that the user exerts sufficient force. This produces a device that delivers doses that are particularly reproducible, regardless of the user.

The device includes a pump, with the stationary portion comprising a pump body and the movable portion comprising a dispenser head. This provides a pump in which activation is independent of the user, but without that significantly modifying its structure. For example, it may suffice to modify only two of the walls of a conventional pump in order to incorporate the abutment means therein. It should be observed that the pump provides a simple manner of delivering doses that are constant while also satisfying the requirement for a pump to be compact. A pump body generally corresponds to an assembly of pump parts mounted in stationary manner on the reservoir of the device, and the dispenser head corresponds to an assembly of parts that are mounted to be movable relative to the pump body.

BRIEF DESCRIPTION OF THE DRAWINGS

The invention can be better understood on reading the following description given purely by way of example and made with reference to the drawings, in which.

DETAILED DESCRIPTION OF THE INVENTION

Figure 1:
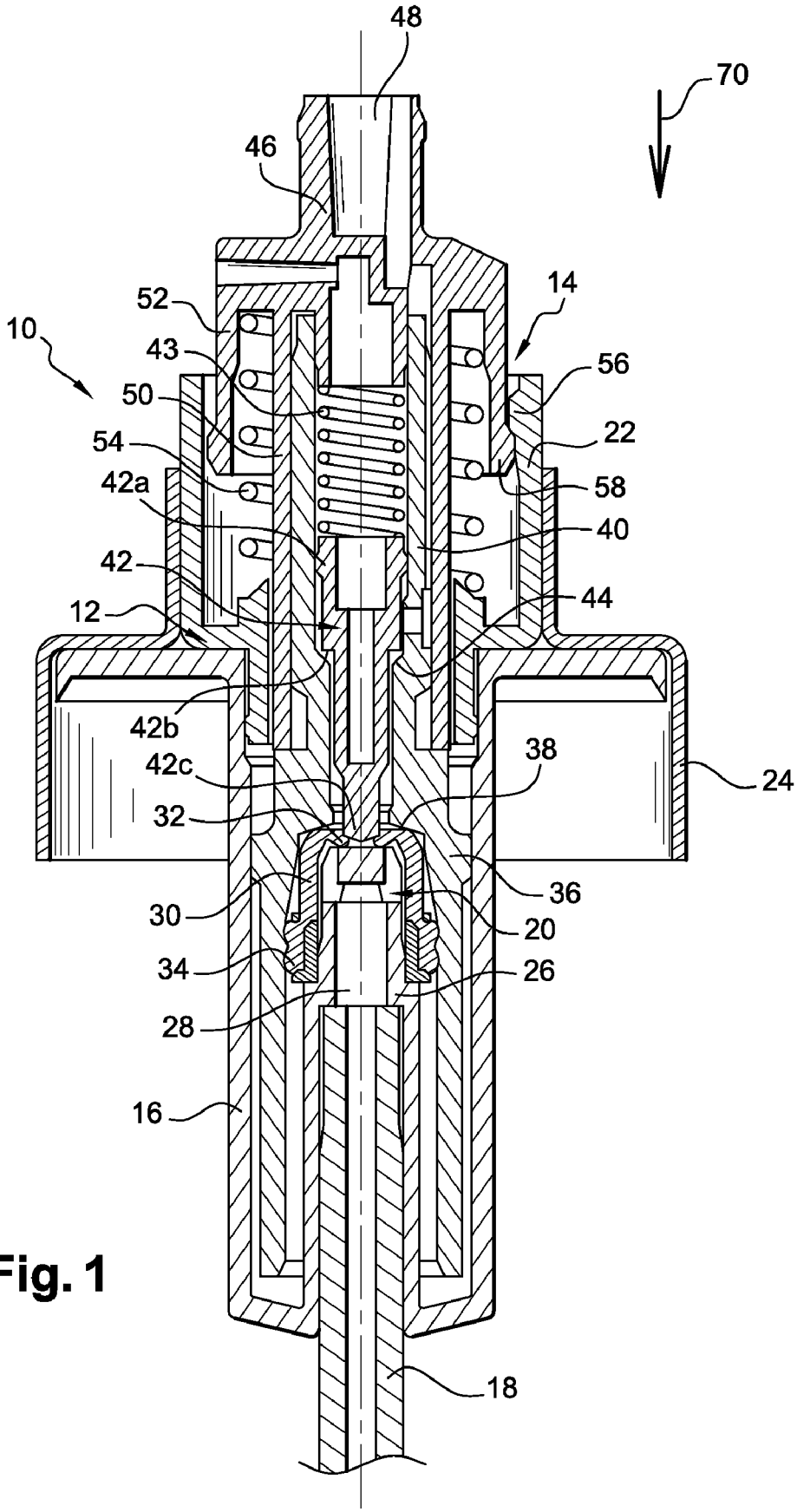
FIG. 1 is a section view of an embodiment of a device for delivering a substance, the device being in the activated position.

As can be seen in FIG. 1, a device for delivering a liquid, semiliquid, viscous, or gaseous substance comprises a pump 10, e.g. used for producing a nasal spray of a pharmaceutical. The pump 10 is designed to be mounted on a reservoir (not shown) and it is generally surmounted by a dispenser endpiece (not shown) on which the user presses.

Figure 2:
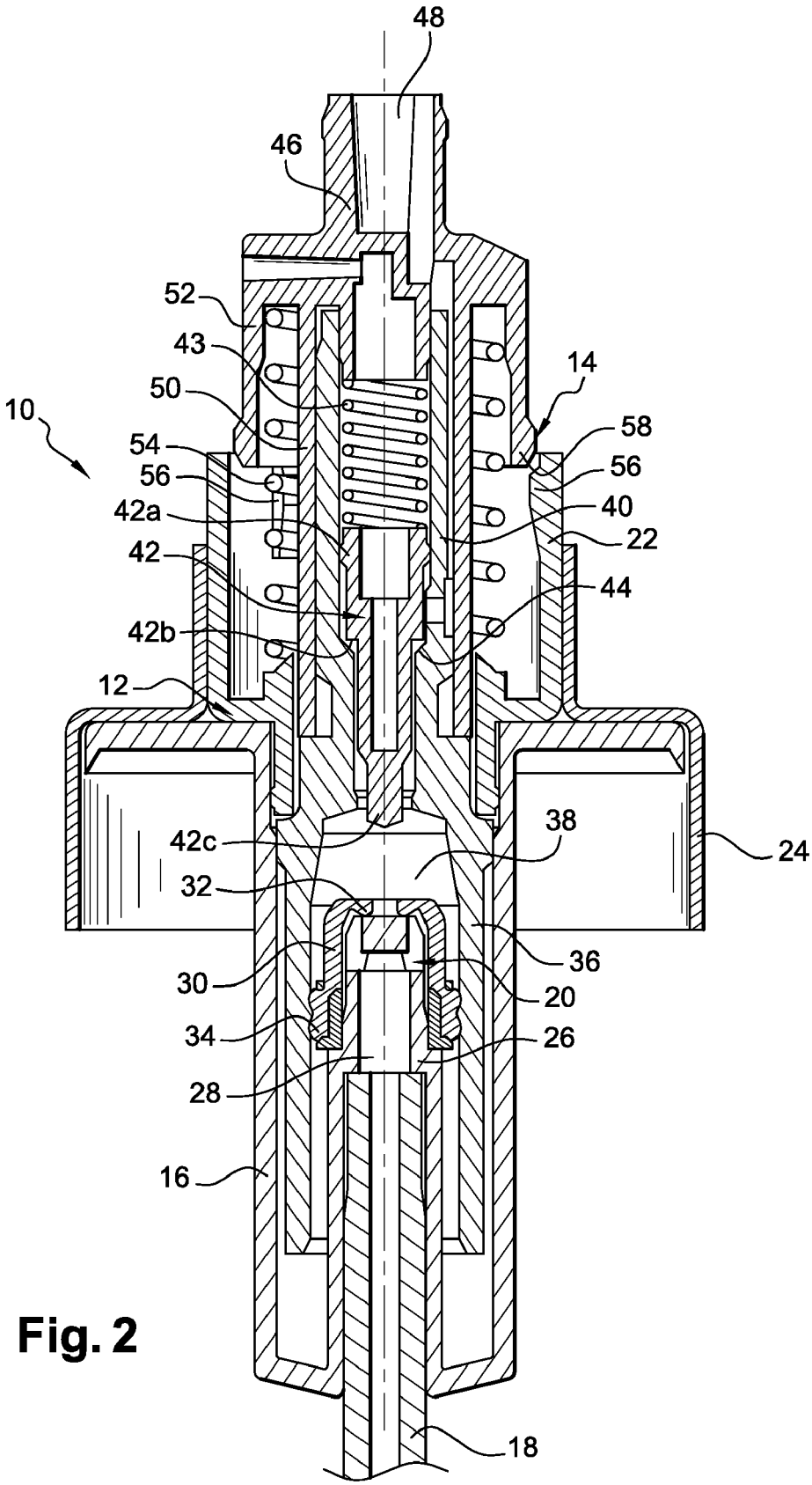
FIG. 2 is a view similar to FIG. 1, the device being in a rest position.

The pump 10 comprises a first portion 12, referred to as a stationary portion, and a second portion 14, referred to as a movable portion, which second portion is movable relative to the stationary portion 12 between a rest position, shown in FIG. 2, and an activated position shown in FIG. 1. In this example, the rest position corresponds to a "high" position and the activated position corresponds to a "low" position.

In this example, the stationary portion 12 comprises a pump body 16 carrying a dip tube 18, a piston 20, and a guide sleeve 22. The tube 18 is connected to the reservoir, in order to draw therefrom the substance that is to pass into the pump. Furthermore, the stationary portion 12 includes a fastener collar 24 enabling the pump 10 to be crimped on the reservoir. It should be understood that the pump may also be mounted on the reservoir by screw fastening or by clip fastening.

The piston 20 has a support 26 mounted stationary in the bottom portion of the pump body 16, with a feed channel 28 passing therethrough, the feed channel being arranged to extend the tube 18 and opening out via one or more feed orifices provided at the top end 32 of the support. The support 26 is also capped at its top end 32 by a deformable membrane 30 that is fastened on the support 26. The membrane 30 is provided with a top transverse wall that co-operates with the top end 32 of the support 26 to form a check valve, and with a cylindrical skirt presenting one or more sealing lips 34.

The movable portion 14 of the pump is also referred to as a dispenser head. In addition to the dispenser endpiece, it has a first cylinder 36 slidably mounted in the pump body 16 and co-operating with the piston 20 to define a metering chamber 38. More precisely, the piston 20 is capable of sliding in leaktight manner relative to the cylinder 36 because of the sealing lips 34, so as to vary the volume of the metering chamber 38. The metering chamber 38 defines a dose volume, corresponding to the difference between the volume of the chamber 38 in the high position and the volume of the chamber 38 in the low position, and referred to as the "dead" volume. This dose volume determines the amount of substance that is delivered on each activation of the device. In FIG. 1, the metering chamber 38 in the low position has a volume (dead volume) that is substantially zero, since the pump is in the activated position, with the dose of substance that was contained in the metering chamber having just been expelled. It should be understood that this dead volume is not necessarily zero. In FIG. 2, the chamber 38 has a volume substantially equal to the volume of one dose of substance.

The dispenser head 14 also has a second cylinder 40 optionally made integrally with the first cylinder 36. Naturally, the cylinders 36 and 40 may be made as a plurality of parts. A plunger 42 is slidably mounted inside the second cylinder 40 to move between a rest position and an activated position under drive from first return means 43 that are constituted by a compression spring. The plunger 42 is provided with a base **42*a* that is mounted in leaktight manner in the second cylinder 40, with a rod 42*b* configured to act, in the rest position of the pump, to close an orifice 44 formed at the bottom end of the second cylinder 40, and with an end 42*c* that projects a little into the metering chamber 38 when the plunger 42 is in the activated position. This end 42*c* is configured to bear against the membrane 30 when the movable portion 14 is in the activated position, thereby guaranteeing that the orifice 44 is opened during a stage of priming the device (thus in such a manner as to expel the air from the metering chamber 38 towards the top of the device) and/or to close the feed orifice of the support 26**.

The dispenser head 14 also has a support 46 fastened to the first cylinder 36. The support 46 defines a dispenser chamber 48. Naturally, the support 46 could be made integrally with the elements 36 and/or 40. The dispenser endpiece of the device is generally mounted on the support 46, with the chamber 48 being connected to a dispenser nozzle provided on the endpiece. It should be observed that the chamber 48 is not necessarily present in the support 46, and provision may be made merely for a connection between the support 46 and/or the cylinder 40 with the dispenser endpiece. The support 46 of the head 14 is provided with an inner skirt 50 and an outer skirt 52, between which second return means 54 are housed. The return means 54 are made up of a compression spring bearing firstly against the support 46 between the two skirts 50 and 52, and secondly against the stationary portion 12 at the bottom of the sleeve 22. By means of the spring 54, the head 14, which is movable relative to the stationary portion 12 between a rest position and an activated position, is held in the high position, as shown in FIG. 1. Inside the inner skirt 50, the support 46 also presents a bearing seat for the first spring 43. The support 46 also has means for allowing liquid to pass from the metering chamber 38 towards the dispenser endpiece, and more precisely towards the dispenser chamber 48, which means are arranged in particular between the second cylinder 40 and the inner skirt 50, preferably in such a manner as to allow the liquid to pass without the liquid coming into contact with the return means 43 and 54.

Figure 3:
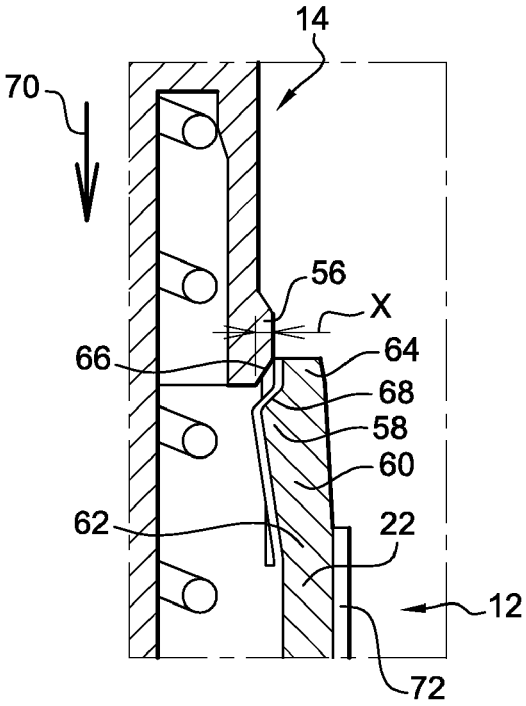
FIG. 3 is a view of a portion of the FIG. 1 device, in the rest position.

The pump 10 also has means 56, 58 for putting the movable portion 14 into abutment relative to the stationary portion 12, which means need to be forced past in order to enable the portion 14 to go from its rest position to its activated position. The means 56, 58 are shown in greater detail in FIG. 3. In this example, they comprise three abutments 56 carried by the movable portion 14, and three abutments 58 carried by the stationary portion 12. In the example of FIG. 3, each of the abutments 58 is mounted on a resilient portion 60 of the stationary portion 12, and more precisely the sleeve 22. The resilient portion 60 is a resilient tab, presenting an end 62 formed integrally with the stationary portion 12 and a free end 64. The resilient tab 60 is deformable between an abutment configuration shown in FIG. 3 and a retracted configuration. In its abutment configuration, the free end 64 of the tab 60 is situated vertically relative to the end 62. In its retracted configuration, the abutment 58 is moved towards the right through a distance X shown in FIG. 3. This movement is achieved by elastically deforming the tab 60, the abutment 56 presenting a chamfer 66 forming a ramp that co-operates with a complementary chamfer 68 of the abutment 58 when the movable portion is moved downwards, along arrow 70.

In this example, three resilient tabs are provided on the stationary portion 12, however it would naturally be possible to provide fewer or more tabs. It should be observed that it is advantageous to provide abutments at three points so as to ensure that the movable portion is held stationary at rest. Furthermore, it should be understood that the abutment means 56, 58 may be of other shapes.

The abutment means 56, 58 are permanent, and thus not fusible, i.e. they are designed to be forced past each time the pump is activated by the user. They are configured in such a manner that the force necessary to force past them is greater than the force necessary for dispensing a dose of substance. Furthermore, it should be observed that the means 56, 58 are substantially punctual.

The pump 10 also has means for reinforcing the resilient portion 60, said means bearing against the zone 62 of the portion 60. In this example, the reinforcing means comprise a belt 72 carried by the fastener collar 24 and bearing against portions of the tabs 60 so as to increase their resistance prior to deforming. This increases the minimum force that the user must exert.

The operation of the pump of FIGS. 1, 2, and 3, when assembled on the reservoir and provided with a dispenser endpiece, is described below.

Before the user delivers a dose of substance, the pump 10 is in the rest or high position, as shown in FIG. 2. In this position, the pump is already primed, i.e. the metering chamber 38 has a certain volume, referred to as its high position volume, and it is full of substance, the substance contained in the chamber 38 comprising the dose of substance that is to be dispensed. In other words, as can be seen in FIG. 2, the rest position corresponds to a position in which the first cylinder 36 and thus the entire movable portion 14 is offset upwards relative to the stationary portion 12, and in particular relative to the pump body 16. In this position, the plunger 42 is pressed against the bottom end of the cylinder 40 under drive from the spring 43, with the rod 42*b* co-operating with the orifice 44 so as to close said orifice. Furthermore, in this position, the end 42*c* of the plunger 42 is not in contact with the piston 20, the piston being low in the metering chamber 38. In this rest position, the abutment means 56, 58 have not yet been forced past, since the user has not pressed on the pump in order to activate it, so these means are in a position similar to that shown in FIGS. 2 or FIG. 3.

When the user desires to dispense a dose of substance, the user presses on the movable portion 14 of the pump 10, possibly by pressing on the dispenser endpiece. This exerts a force on the movable portion 14 (represented by arrow 70 in FIG. 3) for the purpose of activating the pump 10. Under the action of this force, the movable portion 14 begins to move downwards, until the abutment means 56, 58 come into contact and thus exert resistance to the thrust from the user. Following the abutment means 56, 58 being put into abutment, two outcomes are possible.

Either the user exerts sufficient force for the chamfers 66, 68 to move the ends 64 through the distance X, i.e. sufficient force to force past the means 56, 58. Under such circumstances, the user has pressed hard enough to be capable of activating the pump and dispensing a satisfactory dose of substance, as explained below.

Or else the force exerted by the user is not sufficient for forcing past the means 56, 58. Under such circumstances, since the means 56, 58 prevent the movable portion 14 from moving, the user is constrained to exert a greater force on the movable portion 14 in order to force past the means 56, 58. This greater force exerted by the user is then transmitted to the remainder of the pump 10 in order to activate it and ensure that a satisfactory dose of substance is dispensed, as explained below.

Once the means 56, 58 have been forced past, the movable portion 14 continues its downward stroke, as represented by arrow 70. Thus, with the support 46 moving downwards, the first and second cylinders 36 and 40 are also moved downwards, thereby having the effect of reducing the volume of the metering chamber 38. More precisely, the liquid contained in said chamber exerts upward pressure on the plunger 42, such that the rod 42*b* is moved and no longer closes the orifice 44. The liquid can thus escape from the chamber 38. Once the liquid has passed through the orifice 44, it flows between the second cylinder 40 and the inner skirt 50, and then passes into the dispenser chamber 48, in order to be delivered out from the dispenser endpiece. It should be observed that when the volume of the metering chamber 38 diminishes down to its low position volume, in this example down to substantially zero, the liquid exerts pressure on the plunger 42 in order to raise it. In an optional embodiment, the end 42*c* of the plunger in the low position bears against the membrane 30 so as to press it against the top end 32 of the support 26, thereby closing the feed orifice(s).

Once the metering chamber 38 has reached its low position volume, in this example substantially zero volume, i.e. once the dose of substance has been dispensed, the user ceases to press on the movable portion 14. Under drive from the spring 43, the plunger 42 is once more pressed against the bottom wall of the cylinder 40 so as to close the orifice 44. Furthermore, under drive from the spring 54, the movable portion 14 returns upwards in the opposite direction to arrow 70. The spring 54 also causes the second cylinder 36 to slide relative to the piston 20 in the opposite direction to arrow 70, such that the metering chamber 38 increases in volume, thereby creating suction and sucking in substance through the dip tube 18. The movable portion 14 moves upwards to its initial rest position. In this position, the metering chamber 38 is once more full of substance, and in the high position it has a volume that is identical to the volume it had initially, thus making it possible to dispense another dose of volume that is identical to the volume of the dose that has just been dispensed.

It should be understood that the abutment means 56, 58 may be of shapes other than those shown in FIGS. 1 to 3. For example, in the variant shown in FIG. 4, not only is the abutment 58 carried by a deformable tab 60, but the abutment 56 is likewise carried by a deformable tab 74, itself carried by the outer skirt 52 of the support 46. In another variant, the deformable tab(s) 60 may be formed on the movable portion 14 only.

Figure 5:
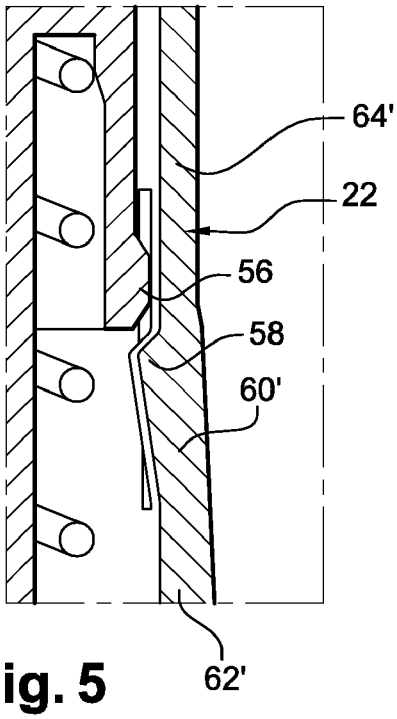
FIG. 5 is a view similar to FIG. 3, showing a second embodiment.

Furthermore, in a second embodiment as shown in FIG. 5, the resilient portion comprises a tab 60' having two opposite ends 62' and 64', which each end 62', 64' being fastened to the stationary portion 12, and more precisely to the guide sleeve 22. In this embodiment, it is the middle portion of the tab 60' that deforms when forcing past the means 56, 58. It should be understood that such a configuration for the tab 60' makes it possible to provide a relatively high level of resistance to forcing past the means 56, 58.

Figure 6:
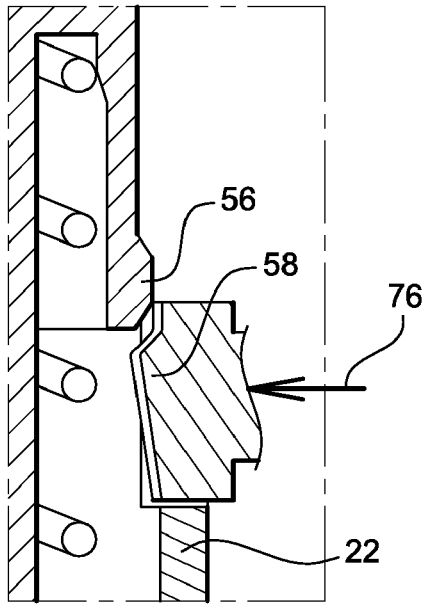
FIG. 6 is a view similar to FIG. 3, showing a third embodiment.

In the embodiment of FIG. 6, the abutment 58 is mounted to be slidable relative to the stationary portion 12, more precisely relative to the sleeve 22. This abutment 58 is movable between a retracted position and an abutment position, as shown in FIG. 6. This movement is driven by return means bearing against the abutment 58, e.g. a spring or a resilient arm exerting a force on the abutment 58 as represented by reference 76. The abutment 58 could optionally be slidably mounted relative to the movable portion 14.

In yet another particular variant, it is possible to combine the resilient portion 60 of FIG. 3 with the return means of FIG. 6. Thus, a spring may bear against an abutment 58 that is not slidably mounted relative to the stationary portion 12, but that is directly incorporated on the stationary portion 12. The portion 60 is deformable between an abutment configuration and a retracted configuration, being urged towards its abutment configuration by return means similar to those of FIG. 6. One of the advantages of this variant lies in the fact that the abutment takes place directly in the stationary portion or the movable portion, and therefore does not require an additional specific part to be assembled.

Figure 4:
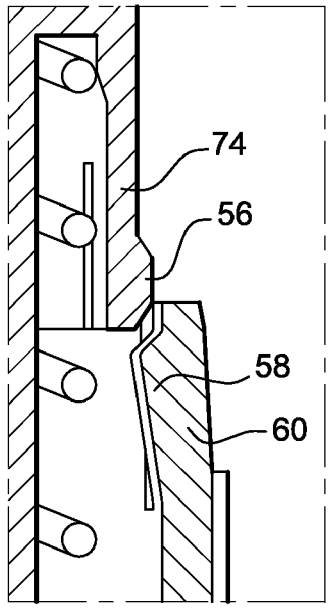
FIG. 4 is a view similar to FIG. 3, showing an embodiment variation.

It should be understood that the structure and the operation of the examples of FIGS. 4 to 6 are similar to the structure and operation of FIGS. 1, 2, and 3.

It should be observed that the device described is not restricted to the above-described examples. In particular, the abutment means 56, 58 may be provided on other parts of the stationary portion 12 and of the movable portion 14. It is possible, optionally, to envisage said means being provided between the pump body 16 and the top of the second cylinder 36, or indeed between the endpiece mounted on the movable portion 14 and the sleeve 22. Providing the means 56, 58 respectively on the support 46 and the sleeve 22 is particularly satisfactory, since the abutment means are then arranged in a zone that does not require sealing, since the substance does not flow through that zone. Furthermore, having the means 56, 58 located in this way keeps them far enough away from the action of a user's fingers to reduce any risk of malfunction.

What is claimed is:

1. A device for delivering a substance, the device comprising a stationary portion and a movable portion that is movable relative to the stationary portion between a rest position and an activated position, the device further comprising abutments for putting the movable portion into abutment relative to the stationary portion, wherein the abutments need to be forced past in order to enable the movable portion to go from the rest position to the activated position, the abutments comprising a first abutment carried by the movable portion and a second abutment carried by the stationary portion, at least one of the first and second abutments being mounted on a resilient portion of the stationary portion and/or of the movable portion, the resilient portion being deformable between an abutment configuration and a retraction configuration and having a reinforcing part that bears against a zone of the resilient portion, wherein the reinforcing part reinforces the resilient portion and increases resistance of the resilient portion during deformation between the abutment configuration and the retraction configuration.

2. The device according to claim 1, wherein the abutments are permanent, being designed to be forced past on each activation of the device by a user.

3. The device according to claim 1, wherein the abutments are configured in such a manner that the force needed to force past the abutments is greater than the force needed for the movable portion to reach an end of a stroke of the movable portion.

4. The device according to claim 1, wherein the resilient portion is a resilient tab.

5. The device according to claim 1, wherein the resilient portion comprises a tab having two opposite ends, the two ends being fastened on the stationary portion or the movable portion.

6. The device according to claim 1, comprising a pump, the stationary portion comprising a pump body and the movable portion comprising a dispenser head.

7. The device according to claim 1, wherein the abutments are substantially punctual such that a distance along which the abutments need to be forced past is short relative to a distance of travel of the movable portion from the rest position to the activated position.

8. The device according to claim 7, wherein the distance along which the abutments need to be forced past is less than half of the distance of travel of the movable portion.

9. The device according to claim 1, wherein the abutments are configured to exert a radial force as the movable portion is forced past the abutments, wherein the radial force is exerted over less than half of a distance of travel of the movable portion from the rest position to the activated position.

10. The device according to claim 1, wherein the resilient portion comprises at least one resilient tab, and wherein the reinforcing part comprises a belt that bears at least partially against the at least one resilient tab.

11. The device according to claim 10, wherein the belt bears against only a lower portion of the resilient tab.

12. The device according to claim 10, further comprising a fastener collar, said fastener collar comprising the belt.

13. The device according to claim 1, wherein the reinforcing part circumscribes the resilient portion.

14. The device according to claim 1, further comprising a fastener collar, said fastener collar comprising the reinforcing part.

15. A device for delivering a substance, the device comprising a stationary portion and a movable portion that is movable relative to the stationary portion between a rest position and an activated position the device further comprising abutments for putting the movable portion into abutment relative to the stationary portion, wherein the abutments need to be forced past in order to enable the movable portion to go from the rest position to the activated position, the abutments comprising a first abutment carried by the movable portion and a second abutment carried by the stationary portion, at least one of these abutments being mounted on a resilient portion of the stationary portion and/or of the movable portion, the resilient portion being deformable between an abutment configuration and a retraction configuration and having a reinforcing part for reinforcing the resilient portion, the reinforcing part bearing against a zone of the resilient portion, wherein one of the first and second abutments is slidably mounted relative to the stationary portion or to the movable portion, being movable between a retracted position and an abutment position under drive from a spring or a resilient arm bearing against said abutment.

* * * * *